US006736910B2

(12) United States Patent
Toyooka et al.

(10) Patent No.: US 6,736,910 B2
(45) Date of Patent: May 18, 2004

(54) HIGH CARBON STEEL PIPE EXCELLENT IN COLD FORMABILITY AND HIGH FREQUENCY HARDENABILITY AND METHOD FOR PRODUCING THE SAME

(75) Inventors: Takaaki Toyooka, Aichi (JP); Yoshikazu Kawabata, Aichi (JP); Akira Yorifuji, Aichi (JP); Masanori Nishimori, Aichi (JP); Motoaki Itadani, Aichi (JP); Takatoshi Okabe, Aichi (JP); Masatoshi Aratani, Aichi (JP); Yasue Koyama, Aichi (JP)

(73) Assignee: JFE Steel Corporation (JP)

( * ) Notice: Subject to any disclaimer, the term of this patent is extended or adjusted under 35 U.S.C. 154(b) by 0 days.

(21) Appl. No.: 10/048,322

(22) PCT Filed: Jun. 14, 2001

(86) PCT No.: PCT/JP01/05054

§ 371 (c)(1),
(2), (4) Date: Jan. 29, 2002

(87) PCT Pub. No.: WO01/96624

PCT Pub. Date: Dec. 20, 2001

(65) Prior Publication Data

US 2002/0153070 A1 Oct. 24, 2002

(51) Int. Cl.[7] ..... C22C 38/02; C22C 38/04

(52) U.S. Cl. ..... 148/320; 148/332; 148/336; 148/335; 148/334; 148/333; 148/909

(58) Field of Search ..... 148/320, 332, 148/336, 335, 334, 333

(56) References Cited

U.S. PATENT DOCUMENTS 6,290,789 B1 * 9/2001 Toyooka et al. ..... 148/593
6,331,216 B1 * 12/2001 Toyooka et al. ..... 148/320

FOREIGN PATENT DOCUMENTS

JP 1-278339 * 11/1989 ..... B32B/15/06

* cited by examiner

*Primary Examiner*—Deborah Yee
(74) *Attorney, Agent, or Firm*—Piper Rudnick LLP

(57) ABSTRACT

The invention provides a high-carbon steel pipe having superior cold workability and induction hardenability, and a method of producing the steel pipe. The method comprises the steps of heating or soaking a base steel pipe having a composition containing C: 0.3 to 0.8%, Si: not more than 2%, and Mn: not more than 3%, and then carrying out reducing rolling on the base steel pipe at least in the temperature range of ($Ac_1$, transformation point −50° C.) to $Ac_1$, transformation point with an accumulated reduction in diameter of not less than 30%. A structure in which the grain size of cementite is not greater than 1.0 μm is obtained, thus resulting in improved cold workability and induction hardenability.

6 Claims, 1 Drawing Sheet

FIGURE
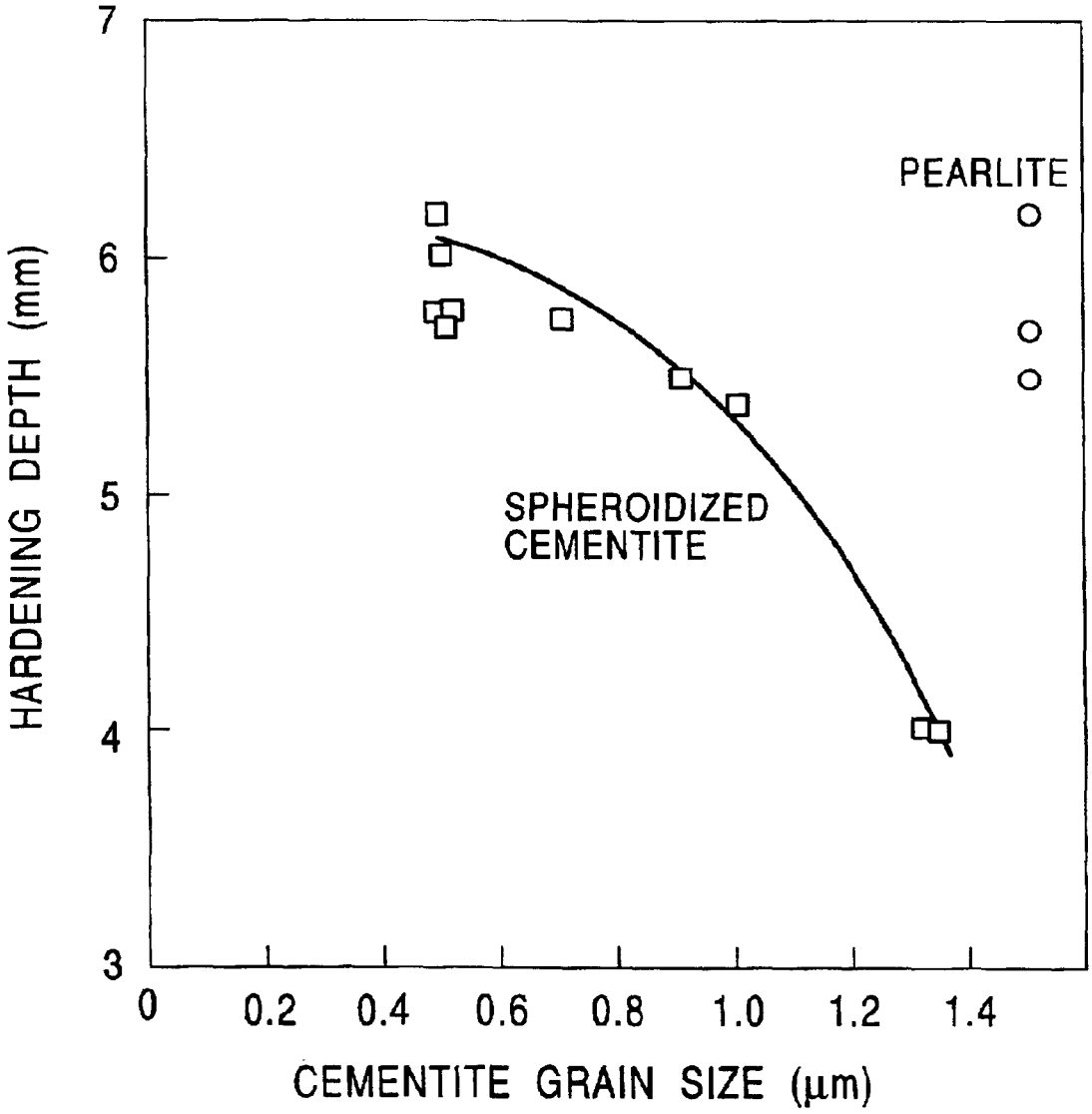

HIGH CARBON STEEL PIPE EXCELLENT IN COLD FORMABILITY AND HIGH FREQUENCY HARDENABILITY AND METHOD FOR PRODUCING THE SAME

TECHNICAL FIELD

The present invention relates to a high-carbon steel pipe and a method of producing the steel pipe. More particularly, the present invention relates to a seam welded steel pipe made of high carbon steel which is suitable for use as, e.g., a steering shaft and a drive shaft of automobiles, and a method of producing the steel pipe.

BACKGROUND ART

Recently, there has been a keen demand for a reduction in weight of an automobile body from the viewpoint of preservation of the global environment. The program for reducing the weight of an automobile body has hitherto been progressed by replacing steel bars, conventionally used to manufacture parts, with seam welded steel pipes. The use of seam welded steel pipes for parts which have conventionally been manufactured using steel bars, however, causes the following problem with the parts made of high carbon steel, such as a steering shaft and a drive shaft.

The parts made of high carbon steel have hitherto been manufactured from high carbon steel bars into predetermined shapes by cutting. When seam welded steel pipes are used in place of steel bars, the parts cannot often be machined into the predetermined shapes by cutting alone because the seam welded steel pipe has a thin wall thickness. Also, because of being made of high carbon steel, the seam welded steel pipe is poor in cold workability and has a difficulty in cold working, such as swaging and expansion, to obtain the predetermined shape. In view of those problems, a method of joining seam welded steel pipes having different diameters together by pressure welding is proposed, for example, in manufacture of drive shafts. However, that proposed method requires a high production cost in the process of pressure welding, and has another difficulty in ensuring reliability in the joined portion. For those reasons, an improvement in cold workability of seam welded steel pipes made of high carbon steel has keenly been demanded in the art.

A seam welded steel pipe made of high carbon steel is produced by the steps of shaping a steel strip into the form of a pipe by cold roll-forming and then joining adjacent ends of the pipe to each other by electrical resistance seam welding. During those pipe forming steps, not only work hardness is greatly increased, but also the hardness of a seamed portion is increased by the welding, thus resulting in a steel pipe with very poor cold workability. For that reason, it is usual before cold working to heat the produced steel pipe up to the austenitic range and then hold it to stand for cooling, that is, to perform normalizing at about 850° C. for about 10 minutes, so that the steel structure is transformed and recrystallized into a structure of ferrite and pearlite. However, a seam welded steel pipe made of high carbon steel and produced by the above conventional method has cold workability that cannot be regarded as sufficient, because it contains pearlite in too large amount. It is said that the range of C content to provide good cold workability has an upper limit of about 0.3%. In a seam welded steel pipe having the C content at such a level, however, sufficient fatigue strength cannot be obtained even if the steel pipe is subjected to heat treatment of hardening and tempering. The seam welded steel pipe is required to have a relatively high value of the C content for providing high fatigue strength.

As one method of producing a steel pipe having high fatigue strength, Japanese Unexamined Patent Application Publication No. 11-77116, for example, discloses a method of producing a steel pipe having high fatigue strength, in which reducing rolling is performed on a base steel pipe, containing C: more than 0.30% to 0.60%, at 400–750° C. with an accumulated reduction in diameter of not less than 20%. The invention disclosed in Japanese Unexamined Patent Application Publication No. 11-77116 is intended to perform warm reducing rolling on a base steel pipe to provide high strength with the tensile strength of not less than 600 MPa, thereby increasing the fatigue strength. According to the invention disclosed in Japanese Unexamined Patent Application Publication No. 11-77116, the fatigue strength is surely increased with an increase in tensile strength, but it is not always guaranteed that a high-carbon steel pipe being soft and having superior cold workability is obtained, because the disclosed invention takes an approach of the reducing rolling at relatively low temperatures for an increase in tensile strength.

Also, as a method of producing a steel pipe having high toughness and high ductility, Japanese Unexamined Patent Application Publication No. 10-306339 discloses a method of producing a steel material (steel pipe) having high toughness and high ductility, in which a base material (steel pipe) containing C: not more than 0.60% is subjected to rolling in the temperature range of ferrite recrystallization with a reduction in area of not less than 20%. The invention disclosed in Japanese Unexamined Patent Application Publication No. 10-306339 is intended to make the steel structure finer to produce a structure of fine ferrite, or a structure of fine ferrite+pearlite, or a structure of fine ferrite+cementite, thereby obtaining the steel material (steel pipe) having high toughness and high ductility. With the invention disclosed in Japanese Unexamined Patent Application Publication No. 10-306339, however, crystal grains are made finer to increase the strength and to obtain high toughness and high ductility. To that end, the disclosed invention takes an approach of the reducing rolling at relatively low temperatures for avoiding the crystal grains from becoming coarser. It is hence not always guaranteed that a high-carbon steel pipe being soft and being superior in cold workability and induction hardenability is obtained.

On the other hand, one conceivable method for improving cold workability of a seam welded steel pipe, which has a high value of the C content and provides high fatigue strength, is to anneal the seam welded steel pipe for spheroidizing cementite. However, spheroidization annealing generally requires heat treatment to be performed at about 700° C. for a long time of several hours, and therefore increases the production cost. Another problem is that, with spheroidization of cementite, the induction hardenability is reduced and a desired level of strength is not obtained after the heat treatment.

Furthermore, for accelerating the spheroidization of cementite, it is also conceivable to perform the steps of cold working and then annealing of a seam welded steel pipe after normalizing. With this method, lamellar cementite in pearlite is likewise mechanically finely broken into fragments, but dislocations being effective in accelerating dispersion of carbon and serving as precipitation sites of cementate disappear in the process of temperature rise for the annealing. As a result, neither accelerated spheroidization nor fine dispersion of carbides is obtained, and therefore a noticeable improvement in cold workability and induction hardenability is not achieved.

It is an object of the present invention to solve the above-mentioned problems in the related art, and provide a seam welded steel pipe made of high carbon steel, which has superior cold workability and induction hardenability, and a method of producing the steel pipe.

DISCLOSURE OF THE INVENTION

With the view of solving the above-mentioned problems, the inventors have conducted intensive studies for an improvement in induction hardenability of a high-carbon steel pipe containing spheroidized cementite. As a result, the inventors have found that, by carrying out reducing rolling on a seam welded steel pipe made of high carbon steel at least in the temperature range of ($Ac_1$ , transformation point −50° C.) to $Ac_1$ transformation point with an accumulative reduction in diameter (referred to also as an "effective reduction in diameter" in the present invention) of not less than 30%, a structure containing cementite with diameters of not greater than 1 μm finely dispersed in ferrite is created in not only a matrix material but also a seamed portion, whereby the structure is softened and lowering of the induction hardenability can be suppressed. Also, the inventors have found that a high-carbon steel pipe thus produced has such a high r-value in the longitudinal direction as which has not been obtained in the past.

A mechanism, based on which the structure containing cementite with diameters of not greater than 1.0 μm finely dispersed in ferrite is created by carrying out reducing rolling at least in the temperature range of ($Ac_1$ transformation point −50° C.) to $Ac_1$ transformation point with a higher reduction is not yet clarified in detail, but the view of the inventors on that point is as follows.

In the case of steel having the structure of ferrite+pearlite, lamellar cementite in the pearlite is mechanically finely broken into fragments due to work applied during the reducing rolling. On that occasion, since the temperature is sufficiently high and dispersion is accelerated due to the work, the fragmented cementite is quickly changed into the spherical form that is stable from the standpoint of energy. Consequently, the cementite can be spheroidized in such a short time as that has been impossible to realize with conventional simple annealing, and fine dispersion of the cementite can be achieved.

On the other hand, where a steel pipe under the reducing rolling has the martensite structure as in a seamed portion, martensite is decomposed into ferrite and spherical carbides due to heating and work. On that occasion, precipitation of the carbides is accelerated due to the work and a larger number of precipitation sites are generated. Consequently, cementite can be spheroidized in a short time, and a structure containing cementite spheroidized and finely dispersed therein can be obtained.

Further, where the heating temperature prior to the reducing rolling is set to a level not lowerer than the $Ac_1$ transformation point so that a steel pipe under the reducing rolling has a structure of ferrite and super-cooled austenite, the super-cooled austenitic structure is decomposed into ferrite and spherical carbides due to the work. On that occasion, precipitation of the carbides is accelerated due to the work and a larger number of precipitation sites are generated. Consequently, a structure containing cementite spheroidized in a short time and finely dispersed therein can be obtained.

The view of the inventors regarding a mechanism, based on which a high r-value is obtained by carrying out reducing rolling in the temperature range of ($Ac_1$ transformation point −50° C.) to $Ac_1$ transformation point with a higher reduction, is as follows.

By carrying out the reducing rolling on a base steel pipe in the temperature range of ($Ac_1$ transformation point −50° C.) to $Ac_1$ transformation point, in which the structure is primarily ferrite, with an accumulated reduction in diameter of not less than 30%, an ideal aggregation structure due to the rolling, in which the <110> axis is parallel to the longitudinal direction of the pipe and the <111> to <110> axes are parallel to the radial direction thereof, is formed and then further developed through restoration and recrystallization. The aggregation structure due to the rolling produces very great driving forces because crystals are rotated by working strains. Unlike an aggregation structure that is created through recrystallization in the case of obtaining a high r-value in steel sheets, the aggregation structure due to the rolling is less affected by the second phase and the amount of solid solution carbon. Consequently, a high r-value is obtained even for a seam welded steel pipe made of high carbon steel, although such a high r-value has been difficult to realize in steel plates made of high carbon steel. Note that the above-mentioned effect is specific to the reducing rolling. In other words, the effect of providing a high r-value is developed because the drafting force is applied in the circumferential direction in the reducing rolling. Conversely, the r-value is reduced in plate rolling, for example, because the drafting force is applied in the thickness direction of a plate.

The present invention has been accomplished based on the findings described above.

According to a first aspect of the present invention, there is provided a high-carbon steel pipe having superior cold workability and induction hardenability, wherein the steel pipe has a composition containing, by mass %, C: 0.3 to 0.8%, Si: not more than 2%, and Mn: not more than 3%, or, as required, Al: not more than 0.10%, the balance consisting of Fe and inevitable impurities, and the steel pipe has a structure with the grain size of cementite being not greater than 1.0 μm at any positions including a seam. In the high-carbon steel pipe according to the first aspect, preferably, the steel pipe further contains in addition to the aforesaid composition, by mass %, one or more selected from among Cr: not more than 2%, Mo: not more than 2%, W: not more than 2%, Ni: not more than 2%, Cu: not more than 2%, and B: not more than 0.01%. Also, in the high-carbon steel pipe according to the first aspect, preferably, the steel pipe further contains in addition to the aforesaid composition, by mass %, one or more selected from among Ti: not more than 1%, Nb: not more than 1%, and V: not more than 1%.

Further, in the high-carbon steel pipe according to the first aspect, preferably, an r-value is not less than 1.2 in the longitudinal direction of the steel pipe at any positions including the seam.

According to a second aspect of the present invention, there is provided a method of producing a high-carbon steel pipe having superior cold workability and induction hardenability, the method comprising the steps of preparing a base steel pipe having a composition containing, by mass %, C: 0.3 to 0.8%, Si: not more than 2%, and Mn: not more than 3%, or, as required, Al: not more than 0.10%, the balance consisting of Fe and inevitable impurities; and carrying out reducing rolling on the base steel pipe at least in the temperature range of ($Ac_1$ transformation point −50° C.) to $Ac_1$ transformation point with an accumulated reduction in diameter of not less than 30%.

Also, in the method of producing the high-carbon steel pipe according to the second aspect, preferably, the steel pipe further contains in addition to the aforesaid composition, by mass %, one or more selected from among Cr: not more than 2%, Mo: not more than 2%, W: not more than 2%, Ni: not more than 2%, Cu: not more than 2%, and B: not more than 0.01%. Also, in the method of producing the high-carbon steel pipe according to the second aspect, preferably the steel pipe further contains in addition to the aforesaid composition, by mass %, one or more selected from among Ti: not more than 1%, Nb: not more than 1%, and V: not more than 1%.

Further, in the method of producing the high-carbon steel pipe according to the second aspect, preferably, the base steel pipe is a seam welded steel pipe produced by the steps of slitting a steel strip into a predetermined width, removing droops in slit surfaces, and joining the slit surfaces to each other by electrical resistance seam welding.

BRIEF DESCRIPTION OF THE DRAWINGS

FIG. 1 is a graph showing an influence of the grain size of cementite upon induction hardenability.

BEST MODE FOR CARRYING OUT THE INVENTION

A steel pipe of the present invention is a seam welded steel pipe made of high carbon steel and having superior cold workability and induction hardenability, in which an r-value is preferably not less than 1.2. A high r-value improves workability, such as pipe expansion by bulging, including bending, expansion, reduction, axial pressing, etc.

A description is first made of the reasons why the composition of the steel pipe of the present invention is limited as mentioned above. Note that, in the following description, mass % is simply denoted by %.

C: 0.3 to 0.8%

C is an element required to increase the hardness after hardening and to improve the fatigue strength. If the C content is less than 0.3%, the hardness after hardening could not be obtained at a sufficient level and the fatigue strength is also low. On the other hand, if the C content exceeds 0.8%, the hardness after hardening would be saturated and the cold workability would be deteriorated. In the present invention, therefore, the C content was limited to the range of from 0.3 to 0.8%.

Si: Not More Than 2%

Si is an element effective in suppressing the pearlite transformation and increasing the hardenability. If the Si content exceeds 2%, the effect of improving the hardenability would be saturated and the cold workability would be deteriorated. In the present invention, therefore, the Si content was limited to be not more than 2%.

Mn: not more than 3%

Mn is an element effective in lowering the temperature of transformation from austenite to ferrite and improving the hardenability. If the Mn content exceeds 3%, the effect of improving the hardenability would be saturated and the cold workability would be deteriorated. In the present invention, therefore, the Mn content was limited to be not more than 3%.

Al: Not More Than 0.10%

Al is an element acting as a deoxidizer and contained as required. However, the content of Al in excess of 0.10% would increase the amount of oxide-based inclusions and would deteriorate the surface properties. Therefore, the Al content is preferably limited to be not more than 0.10%.

one or more selected from among Cr: not more than 2%, Mo: not more than 2%, W: not more than 2%, Ni: not more than 2%, Cu: not more than 2%, and B: not more than 0.01%

Cr, Mo, W, Ni, Cu and B are each an element for increasing the hardenability, and one or more selected from among them may be contained as required.

Cr is an element effective in increasing the hardenability. However, if the Cr content exceeds 2%, the effect of improving the hardenability would be saturated, thus resulting in lower cost effectiveness because of a mismatch between the expected effect and the increased content, and in addition the cold workability would be deteriorated. Further, Cr is distributed in cementite and acts effectively to lower a melting rate of the cementite during the high-frequency hardening. In the present invention, therefore, the Cr content is limited to be preferably not more than 2% and more preferably less than 0.1%.

Mo is an element effective in increasing the hardenability. However, if the Mo content exceeds 2%, the effect of improving the hardenability would be saturated, thus resulting in lower cost effectiveness because of a mismatch between the expected effect and the increased content, and in addition the cold workability would be deteriorated. In the present invention, therefore, the Mo content is preferably limited to be not more than 2%.

W is an element effective in increasing the hardenability. However, if the W content exceeds 2%, the effect of improving the hardenability would be saturated, thus resulting in lower cost effectiveness because of a mismatch between the expected effect and the increased content, and in addition the cold workability would be deteriorated. In the present invention, therefore, the W content is preferably limited to be not more than 2%.

Ni is an element effective in not only increasing the hardenability, but also improving the toughness. However, if the Ni content exceeds 2%, those effects would be saturated, thus resulting in lower cost effectiveness because of a mismatch between the expected effect and the increased content, and in addition the cold workability would be deteriorated. In the present invention, therefore, the Ni content is preferably limited to be not more than 2%.

Cu is an element effective in not only increasing the hardenability, but also improving the toughness. However, if the Cu content exceeds 2%, those effects would be saturated, thus resulting in lower cost effectiveness because of a mismatch between the expected effect and the increased content, and in addition the cold workability would be deteriorated. In the present invention, therefore, the Cu content is preferably limited to be not more than 2%.

B is an element effective in not only increasing the hardenability, but also reinforcing the grain boundary and preventing quenching cracks. However, if the B content exceeds 0.01%, those effects would be saturated, thus resulting in lower cost effectiveness because of a mismatch between the expected effect and the increased content, and in addition the cold workability would be deteriorated. In the present invention, therefore, the B content is preferably limited to be not more than 0.01%.

One or more selected from among Ti: not more than 1%, Nb: not more than 1%, and V: not more than 1%

Ti, Nb and V are each an element effective in forming carbides and nitrides, suppressing crystal grains from becoming coarser in the weld and during the heat treatment, and improving the toughness. One or more of these elements can be selectively contained as required.

Ti is an element which acts to make N fixed and provide solid solution B effective for the hardenability, and which is effective in producing fine carbides, suppressing crystal grains from becoming coarser in the weld and during the heat treatment, and improving the toughness. However, if the Ti content exceeds 1%, those effects would be saturated, thus resulting in lower cost effectiveness because of a mismatch between the expected effect and the increased content. In the present invention, therefore, the Ti content is preferably limited to be not more than 1%.

Nb is an element effective in suppressing crystal grains from becoming coarser in the weld and during the heat treatment, and improving the toughness. However, if the Nb content exceeds 1%, those effects would be saturated, thus resulting in lower cost effectiveness because of a mismatch between the expected effect and the increased content. In the present invention, therefore, the Nb content is preferably limited to be not more than 1%.

V is an element effective in producing fine carbides, suppressing crystal grains from becoming coarser in the weld and during the heat treatment, and improving the toughness. However, if the V content exceeds 1%, those effects would be saturated, thus resulting in lower cost effectiveness because of a mismatch between the expected effect and the increased content. In the present invention, therefore, the V content is preferably limited to be not more than 1%.

The balance other than the above-mentioned components consists of Fe and inevitable ingredients.

Next, the structure of the steel pipe of the present invention will be described below.

The high-carbon steel pipe of the present invention has a structure in which fine cementite is precipitated in ferrite. In the steel pipe of the present invention, the grain size of cementite is not greater than 1.0 $\mu$m. As shown in FIG. 1, when the grain size of cementite is not greater than 1.0 $\mu$m, the high-frequency hardening depth is substantially equal to that in conventional steel having a structure of high carbon ferrite+pearlite. If the grain size of cementite exceeds 1.0 $\mu$m, the induction hardenability would be deteriorated to such an extent that a resulting steel pipe would be unsuitable for an automobile part such as a drive shaft.

Next, the method of producing the steel pipe of the present invention will be described below.

In the present invention, the high-carbon steel pipe (base steel pipe) having the above-described composition is preferably subjected to heating or soaking prior to reducing rolling.

The base steel pipe subjected to the reducing rolling may be a seam welded steel pipe just after being produced by forming a steel plate into a pipe and joining a seam of the pipe by electrical resistance seam welding, or a seam welded steel pipe subjected to seam annealing or normalizing after those steps. A steel plate used in producing the seam welded steel pipe may be any of a hot-rolled steel plate, a hot-rolled steel plate after annealing, a cold-rolled steel plate, and a cold-rolled steel plate after annealing. In addition, the structure of the steel pipe subjected to the reducing rolling may contain any of ferrite, pearlite, martensite, and carbides.

Also, the reducing rolling in the present invention has no restrictions upon the preceding history. For example, the heating or soaking temperature prior to the reducing rolling in the present invention may be in any of the austenite single-phase range, the austenite and ferrite two-phase range, the ferrite and carbide two-phase range, etc. Further, prior to the reducing rolling in the present invention, the base steel pipe may be subjected to rolling at a temperature at which the structure is in the austenite single phase or is primarily austenite.

In the present invention, the steel pipe is finished by carrying out the reducing rolling on the base steel pipe at least in the temperature range of ($Ac_1$ transformation point −50° C.) to $Ac_1$ transformation point with an accumulated reduction in diameter of not less than 30%.

The accumulated reduction in diameter within the temperature range of ($Ac_1$ transformation point −50° C.) to $Ac_1$ transformation point is also referred to as the effective reduction in diameter in the present invention. By setting the effective reduction in diameter to be no less than 30%, spheroidization of cementite is accelerated and the grain size of cementite is reduced to 1.0 $\mu$m or below. As a result, a high-carbon steel pipe having superior cold workability and high-frequency hardening is obtained. Note that, in the present invention, there are no restrictions upon the history prior to the reducing rolling step so long as the steel pipe is finished by carrying out the reducing rolling on the base steel pipe in the temperature range of ($Ac_1$ transformation point −50° C.) to $Ac_1$ transformation point with an accumulated reduction in diameter of not less than 30%. For example, the rolling schedule may be set such that, after heating the base steel pipe to temperatures beyond $Ac_3$ and carrying out the reducing rolling in the temperature range of $Ac_3$ to $Ac_1$, the base steel pipe is subjected for finishing to the reducing rolling in the temperature range of ($Ac_1$ transformation point −50° C.) to $Ac_1$ transformation point with an accumulated reduction in diameter of not less than 30%.

If the reducing rolling temperature exceeds the $Ac_1$ transformation point, carbides would not be present during the rolling and therefore spheroidization of cementite would not be accelerated. Conversely, the reducing rolling temperature is lower than a level of ($Ac_1$ transformation point −50° C.), the rolling load would be greatly increased and the work hardness would be increased, thus resulting in deterioration of the cold workability. On the other hand, if the accumulated reduction in diameter is less than 30%, the above-described effects would not be obtained. For those reasons, the reducing rolling is performed in the present invention at least in the temperature range of ($Ac_1$ transformation point −50° C.) to $Ac_1$ transformation point with an accumulated reduction in diameter of not less than 30%.

Also, the reducing rolling may be performed under lubrication. The lubrication is advantageous in suppressing the occurrence of flaws and reducing the rolling load.

Further, by setting a reduction in diameter to a larger value, it is possible to obtain a higher r-value and to improve workability, such as pipe expansion by bulging, including bending, expansion, reduction, etc.

Moreover, in the present invention, the base steel pipe is preferably produced by the steps of slitting a steel strip into a predetermined width, removing droops in slit surfaces, and joining the slit surfaces to each other by electrical resistance seam welding.

If the electrical resistance seam welding is performed with droops left in the slit surfaces after slitting the steel strip into the predetermined width, center segregation would be often greatly enlarged in the thickness direction of a wall plate, thus resulting in deterioration of both workability and hardenability in the seam. When producing the base steel pipe in the present invention, therefore, it is preferable to slit a steel strip into a predetermined width, remove droops in slit surfaces, and joining the slit surfaces to each other by electrical resistance seam welding.

Additionally, a steel pipe being softer and having higher dimensional accuracy can also be produced by further carrying out a step of annealing the steel pipe of the present invention at temperatures not higher than the $Ac_1$ transformation point, or steps of annealing the steel pipe of the present invention at temperatures not higher than the $Ac_1$ transformation point, cold-drawing it, and then annealing the reduced pipe again at temperatures not higher than the $Ac_1$ transformation point, or steps of cold-drawing the steel pipe of the present invention and then annealing it at temperatures not higher than the $Ac_1$ transformation point.

EXAMPLES

Seam welded steel pipes were produced by shaping each of hot-rolled steel plates having chemical compositions, shown in Table 1, into a pipe with roll forming, and joining both ends of the pipe to each other by electrical resistance seam welding. These seam welded steel pipes were used as base steel pipes, and the reducing rolling was performed on them under conditions shown in Tables 2 and 3, whereby product pipes (outer diameter: 40 mmϕ, wall thickness: 6 mm) were obtained. As Comparative Examples, seam welded steel pipes (outer diameter: 40 mmϕ, wall thickness: 6 mm) were produced using steel plates having the same compositions, and these seam welded steel pipes were subjected to (1) normalizing of 900° C.×10 minutes or (2) spheroidization annealing of 700° C.×10 hours. As another set of Comparative Examples, seam welded steel pipes (outer diameter: 50.8 mmϕ, wall thickness: 7 mm) were produced using some of the steel plates with electrical resistance seam welding. These seam welded steel pipes were subjected to normalizing of 900° C.×10 minutes and then to cold drawing, whereby product pipes with an outer diameter of 40 mmϕ and a wall thickness of 6 mm were obtained. Spheroidization annealing of 700° C.×10 hours was performed on those product pipes.

Tensile specimens (JIS No. 12-A) were sampled from each of the product pipes in a seamed portion and at a position spaced 180° from the seam in the circumferential direction. A tensile test was made on each specimen to measure tensile characteristics and an r-value. More specifically, after bonding a strain gauge with a gauge length of 2 mm to each specimen, a nominal strain of 6 to 7% was applied to the specimen for the tensile test. Then, a ratio of a true strain $e_L$ in the longitudinal direction to a true strain $e_W$ in the width direction was measured. From a gradient ρ of that ratio, the r-value was calculated based on the formula of r-value=ρ/(−1−ρ).

Further, another specimen was sampled from each of the product pipes. After polishing a cross-sectional surface of the specimen perpendicular to the longitudinal direction with a buff and then etching it with a Nital etchant, areas of 100 pieces of cementite were measured by a scanning electron microscope, and the diameters of those areas in terms of sphere were determined. Incidentally, for the specimen in which a half or more of the measured 100 pieces of cementite had the major axis of cementite being 4 or more times as long as the minor axis thereof, that specimen was judged as being not spheroidized.

Moreover, each of the product pipes was subjected to high-frequency hardening under conditions of frequency of 10 kHz, a surface temperature of 1000° C., and an induction heating coil feeding rate of 20 mm/s, for measuring the hardening depth.

The measured results are listed in Tables 4 and 5.

In any of Inventive Examples, both the seamed portion and the matrix material were soft comparable to those in Comparative Examples subjected to the spheroidization annealing, showed a superior elongation to Comparative Examples subjected to the spheroidization annealing, and showed a higher r-value than all Comparative Examples. Also, any of Inventive Examples had induction hardenability comparable to that of Comparative Examples subjected to the normalizing.

On the other hand, among Comparative Examples departing from the scope of the present invention, those Comparative Examples subjected to the normalizing showed higher strength and a smaller elongation, and those Comparative Examples subjected to the spheroidization annealing showed lower induction hardenability.

Industrial Applicability

According to the present invention, a seam welded steel pipe made of high carbon steel and having superior cold workability and induction hardenability can be inexpensively produced with a high productivity. Therefore, the seam welded steel pipe made of high carbon steel can be applied to automobile parts such as a steering shaft and a drive shaft. As a result, it is possible to simplify the process of manufacturing those parts, to reduce the weight of those parts, and to increase the strength thereof after hardening and tempering, thereby improving the reliability. Hence, the present invention greatly contributes to development of the industry.

TABLE 1

| Steel Plate | Chemical Composition (mass %) | | | | | | | | | | | | | | | $A_{c1}$ |
|---|---|---|---|---|---|---|---|---|---|---|---|---|---|---|---|---|
| No. | c | Si | Mn | P | S | N | Cr | Mo | W | Ni | Cu | Ti | Nb | V | B | ° C. |
| A | 0.30 | 0.46 | 0.75 | 0.01 | 0.004 | 0.003 | — | — | — | — | — | — | — | — | — | 738 |
| B | 0.35 | 0.23 | 0.37 | 0.01 | 0.004 | 0.003 | — | — | — | — | — | — | — | — | — | 736 |
| C | 0.45 | 0.25 | 0.67 | 0.01 | 0.004 | 0.003 | — | — | — | — | — | — | — | — | — | 733 |
| D | 0.50 | 0.25 | 0.91 | 0.01 | 0.004 | 0.003 | — | — | — | — | — | — | — | — | — | 731 |
| E | 0.34 | 0.23 | 1.20 | 0.01 | 0.004 | 0.003 | 0.10 | — | — | — | — | 0.036 | — | — | 0.0021 | 729 |
| F | 0.34 | 0.23 | 1.30 | 0.01 | 0.004 | 0.003 | — | — | — | — | — | 0.036 | — | — | 0.0021 | 726 |
| G | 0.42 | 0.30 | 1.60 | 0.01 | 0.004 | 0.003 | — | — | — | — | — | — | — | — | — | 725 |
| H | 0.33 | 0.20 | 0.62 | 0.01 | 0.004 | 0.003 | — | — | — | 0.89 | — | — | — | — | — | 717 |
| I | 0.32 | 0.20 | 0.64 | 0.01 | 0.004 | 0.003 | — | — | — | — | 1.14 | — | — | — | — | 713 |
| J | 0.39 | 0.26 | 0.67 | 0.01 | 0.004 | 0.003 | — | 0.49 | — | — | — | — | — | — | — | 749 |
| K | 0.32 | 0.19 | 0.51 | 0.01 | 0.004 | 0.003 | 1.37 | 0.48 | — | 3.02 | — | — | — | 0.18 | — | 720 |
| L | 0.39 | 0.26 | 0.67 | 0.01 | 0.004 | 0.003 | — | — | 0.80 | — | — | — | 0.020 | — | — | 739 |

TABLE 2

| Product Pipe No. | Steel Plate No. | Reducing Rolling Conditions: Heating Temperature (° C.) | Incoming-side Temperature in Rolling Mill (° C.) | Outgoing-side Temperature in Rolling Mill (° C.) | Accumulated Reduction in Diameter (%) | Effective Reduction in Diameter* (%) | Heat Treatment |
|---|---|---|---|---|---|---|---|
| 1 | A | 749 | 736 | 706 | 50 | 50 | — |
| 2 | A | | | — | | | spheroidization annealing: 700° C. × 10 hours |
| 3 | A | | | — | | | normalizing: 900° C. × 15 minutes |
| 4 | B | 748 | 734 | 709 | 50 | 50 | — |
| 5 | B | | | — | | | spheroidization annealing: 700° C. × 10 hours |
| 6 | B | | | — | | | normalizing: 900° C. × 15 minutes |
| 7 | C | 743 | 729 | 700 | 50 | 50 | — |
| 8 | C | | | — | | | spheroidization annealing: 700° C. × 10 hours |
| 9 | C | | | — | | | normalizing: 900° C. × 15 minutes |
| 10 | D | 744 | 730 | 703 | 50 | 50 | — |
| 11 | D | | | — | | | spheroidization annealing: 700° C. × 10 hours |
| 12 | D | | | — | | | normalizing: 900° C. × 15 minutes |
| 13 | E | 738 | 727 | 700 | 50 | 50 | — |
| 14 | E | | | — | | | spheroidization annealing: 700° C. × 10 hours |
| 15 | E | | | — | | | normalizing: 900° C. × 15 minutes |
| 16 | F | 737 | 723 | 697 | 50 | 50 | — |
| 17 | F | | | — | | | spheroidization annealing: 700° C. × 10 hours |
| 18 | F | | | — | | | normalizing: 900° C. × 15 minutes |

*effective reduction in diameter: reduction in diameter in temperature range of $Ac_3$ to ($Ac_3$ - 50° C.)

TABLE 3

| Product Pipe No. | Steel Plate No. | Reducing Rolling Conditions: Heating Temperature (° C.) | Incoming-side Temperature in Rolling Mill (° C.) | Outgoing-side Temperature in Rolling Mill (° C.) | Accumulated Reduction in Diameter (%) | Effective Reduction in Diameter* (%) | Heat Treatment |
|---|---|---|---|---|---|---|---|
| 19 | G | 744 | 733 | 707 | 50 | 40 | — |
| 20 | G | 735 | 724 | 695 | 20 | 20 | — |
| 21 | G | 735 | 722 | 695 | 30 | 30 | — |
| 22 | G | 733 | 722 | 696 | 50 | 50 | — |
| 23 | G | 737 | 722 | 692 | 70 | 70 | — |
| 24 | G | | | — | | | spheroidization annealing: 700° C. × 10 hours |
| 25 | G | | | — | | | normalizing: 900° C. × 15 minutes |
| 26 | G | | | — | | | normalizing: 900° C. × 15 minutes → cold drawing → spheroidization annealing: 700° C. × 10 hours |
| 27 | H | 728 | 714 | 687 | 50 | 50 | — |
| 28 | H | | | — | | | spheroidization annealing: 700° C. × 10 hours |
| 29 | H | | | — | | | normalizing: 900° C. × 15 minutes |
| 30 | I | 723 | 709 | 681 | 50 | 50 | — |
| 31 | I | | | — | | | spheroidization annealing: 700° C. × 10 hours |
| 32 | I | | | — | | | normalizing: 900° C. × 15 minutes |
| 33 | J | 756 | 745 | 717 | 50 | 50 | — |
| 34 | J | | | — | | | spheroidization annealing: 700° C. × 10 hours |
| 35 | J | | | — | | | normalizing: 900° C. × 15 minutes |
| 36 | K | 730 | 719 | 690 | 50 | 50 | — |
| 37 | K | | | — | | | spheroidization annealing: 700° C. × 10 hours |
| 38 | K | | | — | | | normalizing: 900° C. × 15 minutes |
| 39 | L | 748 | 734 | 704 | 50 | 50 | — |
| 40 | L | | | — | | | spheroidization annealing: 700° C. × 10 hours |
| 41 | L | | | — | | | normalizing: 900° C. × 15 minutes |

*effective reduction in diameter: reduction in diameter in temperature range of $Ac_3$ to ($Ac_3$ - 50° C.)

TABLE 4

| Product | Position of Steel Pipe Section | | | | | | | | | | |
|---|---|---|---|---|---|---|---|---|---|---|---|
| | 180° | | | | | Seamed Portion | | | | | |
| | Structure Cementite | Tensile Characteristics | | r-Value | Induction Hardenability Depth of Induction | Structure Cementite | Tensile Characteristics | | r-Value | Induction Hardenability Depth of Induction | |
| Pipe No. | Grain Size (μm) | TS (MPa) | EI (%) | r-Value | Hardening (mm) * | Grain Size (μm) | TS (MPa) | EI (%) | r-Value | Hardening (mm) * | Remarks |
| 1 | 0.48 | 550 | 44 | 1.71 | 4.4 | 0.48 | 552 | 43 | 1.72 | 4.4 | Inventive Example |
| 2 | 1.19 | 551 | 40 | 1.85 | 3.2 | 1.19 | 570 | 39 | 0.88 | 3.2 | Comparative Example (spheroidization annealing) |
| 3 | not spheroidized | 617 | 35 | 0.82 | 4.2 | not spheroidized | 619 | 35 | 0.89 | 4.3 | Comparative Example (normalizing) |
| 4 | 0.55 | 587 | 39 | 1.72 | 4.3 | 0.54 | 597 | 38 | 1.80 | 4.4 | Inventive Example |
| 5 | 1.20 | 577 | 34 | 0.86 | 3.3 | 1.19 | 592 | 32 | 0.64 | 3.4 | Comparative Example (spheroidization annealing) |
| 6 | not spheroidized | 668 | 27 | 0.89 | 4.3 | not spheroidized | 690 | 27 | 0.87 | 4.4 | Comparative Example (normalizing) |
| 7 | 0.50 | 641 | 30 | 1.72 | 5.5 | 0.49 | 665 | 30 | 1.74 | 5.5 | Inventive Example |
| 8 | 1.45 | 641 | 26 | 0.87 | 3.8 | 1.43 | 671 | 24 | 0.89 | 3.9 | Comparative Example (spheroidization annealing) |
| 9 | not spheroidized | 747 | 20 | 0.83 | 5.7 | not spheroidized | 763 | 18 | 0.83 | 5.8 | Comparative Example (normalizing) |
| 10 | 0.47 | 659 | 24 | 1.80 | >6 | 0.45 | 687 | 23 | 1.71 | >6 | Inventive Example |
| 11 | 1.32 | 656 | 20 | 0.81 | 5.9 | 1.29 | 563 | 19 | 0.84 | 6.1 | Comparative Example (spheroidization annealing) |
| 12 | not spheroidized | 768 | 16 | 0.87 | >6 | not spheroidized | 791 | 15 | 0.81 | >6 | Comparative Example (normalizing) |
| 13 | 0.47 | 678 | 40 | 1.72 | 5.1 | 0.46 | 600 | 39 | 1.77 | 5.2 | Inventive Example |
| 14 | 1.67 | 580 | 36 | 0.83 | 3.6 | 1.66 | 602 | 35 | 0.90 | 3.7 | Comparative Example (spheroidization annealing) |
| 15 | not spheroidized | 665 | 27 | 0.82 | 5.2 | not spheroidized | 687 | 25 | 0.88 | 5.3 | Comparative Example (normalizing) |
| 16 | 0.53 | 577 | 40 | 1.80 | 4.3 | 0.52 | 595 | 38 | 1.75 | 4.4 | Inventive Example |
| 17 | 1.58 | 582 | 36 | 0.88 | 3.3 | 1.58 | 606 | 34 | 0.90 | 3.4 | Comparative Example (spheroidization annealing) |
| 18 | not spheroidized | 668 | 27 | 0.83 | 4.2 | not spheroidized | 684 | 27 | 0.82 | 4.4 | Comparative Example (normalizing) |

* depth at which hardness reduced 200 in terms of Hv from that at the outermost surface was obtained

TABLE 5

| Product | Position of Steel Pipe Section | | | | | | | | | | |
|---|---|---|---|---|---|---|---|---|---|---|---|
| | 180° | | | | | Seamed Portion | | | | | |
| | Structure Cementite | Tensile Characteristics | | r-Value | Induction Hardenability Depth of Induction | Structure Cementite | Tensile Characteristics | | r-Value | Induction Hardenability Depth of Induction | |
| Pipe No. | Grain Size (μm) | TS (MPa) | EI (%) | r-Value | Hardening (mm) * | Grain Size (μm) | TS (MPa) | EI (%) | r-Value | Hardening (mm) * | Remarks |
| 19 | 0.52 | 597 | 35 | 1.71 | 5.8 | 0.49 | 624 | 34 | 1.70 | >6 | Inventive Example |
| 20 | not spheroidized | 679 | 23 | 0.92 | 5.7 | not spheroidized | 700 | 22 | 0.92 | 6.7 | Comparative Example |
| 21 | 0.90 | 607 | 33 | 1.15 | 5.5 | 1.00 | 615 | 32 | 1.11 | 5.4 | Inventive Example |
| 22 | 0.70 | 604 | 35 | 1.79 | 5.7 | 0.70 | 616 | 33 | 1.79 | 5.7 | Inventive Example |
| 23 | 0.49 | 611 | 35 | 2.12 | 5.7 | 0.49 | 626 | 33 | 2.17 | 5.7 | Inventive Example |
| 24 | 0.50 | 613 | 38 | 0.85 | 6.0 | 0.49 | 638 | 38 | 0.85 | >6 | Comparative Example (spheroidization annealing) |
| 25 | not spheroidized | 721 | 20 | 0.89 | 5.5 | not spheroidized | 721 | 19 | 0.90 | >6 | Comparative Example (normalizing) |
| 26 | 1.34 | 608 | 29 | 1.06 | 4.0 | 1.32 | 628 | 27 | 1.09 | 4.0 | Comparative Example (spheroidization after cold drawing) |
| 27 | 0.42 | 582 | 40 | 1.79 | 5.8 | 0.42 | 596 | 38 | 1.78 | 5.9 | Inventive Example |
| 28 | 1.36 | 584 | 35 | 0.86 | 3.9 | 1.32 | 588 | 34 | 0.81 | 4.0 | Comparative Example (spheroidization annealing) |
| 29 | not spheroidized | 665 | 27 | 0.80 | 5.5 | not spheroidized | 668 | 28 | 0.82 | 5.6 | Comparative Example (normalizing) |

TABLE 5-continued

| Product | Position of Steel Pipe Section | | | | | | | | | | |
|---|---|---|---|---|---|---|---|---|---|---|---|
| | 180° | | | | | Seamed Portion | | | | | |
| | Structure Cementite | Tensile Characteristics | | r-Value | Induction Hardenability Depth of Induction | Structure Cementite | Tensile Characteristics | | r-Value | Induction Hardenability Depth of Induction | |
| Pipe No. | Grain Size (μm) | TS (MPa) | EI (%) | r-Value | Hardening (mm) * | Grain Size (μm) | TS (MPa) | EI (%) | r-Value | Hardening (mm) * | Remarks |
| 30 | 0.40 | 583 | 41 | 1.75 | 5.6 | 0.39 | 583 | 39 | 1.71 | 5.6 | Inventive Example |
| 31 | 1.52 | 583 | 35 | 0.81 | 4.0 | 1.45 | 613 | 36 | 0.84 | 4.1 | Comparative Example (spheroidization annealing) |
| 32 | not spheroidized | 669 | 28 | 0.89 | 5.6 | not spheroidized | 893 | 27 | 0.81 | 5.6 | Comparative Example (normalizing) |
| 33 | 0.50 | 637 | 31 | 1.76 | 5.6 | 0.49 | 657 | 29 | 1.76 | >6 | Inventive Example |
| 34 | 1.43 | 642 | 28 | 0.85 | 4.0 | 1.41 | 670 | 25 | 0.85 | 4.1 | Comparative Example (spheroidization annealing) |
| 35 | not spheroidized | 748 | 19 | 0.80 | 5.6 | not spheroidized | 750 | 19 | 0.86 | 5.8 | Comparative Example (normalizing) |
| 36 | 0.46 | 580 | 39 | 1.73 | 5.4 | 0.46 | 608 | 38 | 1.73 | 5.4 | Inventive Example |
| 37 | 1.75 | 580 | 35 | 0.88 | 3.4 | 1.72 | 607 | 33 | 0.88 | 3.5 | Comparative Example (spheroidization annealing) |
| 38 | not spheroidized | 666 | 27 | 0.84 | 5.7 | not spheroidized | 674 | 27 | 0.88 | >6 | Comparative Example (normalizing) |
| 39 | 0.46 | 645 | 31 | 1.70 | 5.4 | 0.45 | 673 | 29 | 1.79 | 5.6 | Inventive Example |
| 40 | 1.68 | 644 | 26 | 0.82 | 4.1 | 1.54 | 671 | 24 | 0.86 | 4.2 | Comparative Example (spheroidization annealing) |
| 41 | not spheroidized | 755 | 19 | 0.83 | 5.3 | not spheroidized | 771 | 18 | 0.63 | 5.4 | Comparative Example (normalizing) |

* depth at which hardn580 reduced 200 in terms of Hv from that at the outermost surface was obtained

What is claimed is:

1. A high-carbon steel pipe having superior cold workability and induction hardenability, wherein said steel pipe has a composition containing, by mass %, C: 0.3 to 0.8%, Si: not more than 2%, and Mn: not more than 3%, the balance consisting of Fe and inevitable impurities, and said steel pipe has a ferritic structure with cementite wherein the grain size of the cementite is not greater than 1.0 μm at any position including a seam.

2. A high-carbon steel pipe according to claim 1, wherein said steel pipe further contains in addition to said composition, by mass %, one or more selected from among Cr: not more than 2%, Mo: not more than 2%, W: not more than 2%, Ni: not more than 2%, Cu: not more than 2%, and B: not more than 0.01%.

3. A high-carbon steel pipe according to claim 1 or 2, wherein said steel pipe further contains in addition to said composition, by mass %, one or more selected from among Ti: not more than 1%, Nb: not more than 1%, and V: not more than 1%.

4. A high-carbon steel pipe according to claim 1, wherein an r-value is not less than 1.2 in the longitudinal direction of said steel pipe at any positions including the seam.

5. A high-carbon steel pipe according to claim 2, wherein an r-value is not less than 1.2 in the longitudinal direction of said steel pipe at any positions including the seam.

6. A high-carbon steel pipe according to claim 3, wherein an r-value is not less than 1.2 in the longitudinal direction of said steel pipe at any positions including the seam.

* * * * *